US005542202A

United States Patent [19]

Brugger

[11] Patent Number: 5,542,202

[45] Date of Patent: Aug. 6, 1996

[54] CHANGEABLE LETTERS FOR SIGNS

[75] Inventor: Joseph G. Brugger, Palmetto, Fla.

[73] Assignee: Gemini, Inc., Cannon Falls, Minn.

[21] Appl. No.: 456,281

[22] Filed: May 31, 1995

Related U.S. Application Data

[63] Continuation of Ser. No. 75,817, Jun. 11, 1993, abandoned.

[51] Int. Cl.[6] ..... G09F 13/04; G09F 7/10

[52] U.S. Cl. ..... 40/576; 40/618

[58] Field of Search ..... 40/367, 575, 576, 40/615, 618, 442, 443

[56] References Cited

U.S. PATENT DOCUMENTS

| | | | |
|---|---|---|---|
| 885,426 | 4/1908 | Bittle | 40/615 |
| 1,116,803 | 11/1914 | Dainoff | 40/615 |
| 1,644,742 | 10/1927 | Moynihan | 40/576 |
| 2,143,731 | 1/1939 | Gallas | 40/576 |
| 4,292,752 | 10/1981 | Clark | 40/576 |

OTHER PUBLICATIONS

Americraft Corporation, Florida Plastics Brand E–Z Change flat changeable copy catalog, 1984.

*Primary Examiner*—John J. Vrablik
*Assistant Examiner*—William Wicker
*Attorney, Agent, or Firm*—D. L. Tschida

[57] ABSTRACT

A changeable letter for signs is provided as a part of an illuminated sign or copy board system which provides different appearances when the changeable letters are alternately backlit or frontlit. The letter, understood to include letters, symbols and numerals, includes a translucent plate and first, second or additional layers of opaque, indicia-defining material applied thereto. The second layer is preferably of a lighter color than the first layer, and when superposed thereon, presents the appearance of a lighter colored letter surrounded by a darker border. However, when the letter is backlit as it would appear at nighttime positioned on an illuminated sign, the letter presents a black or otherwise darkened appearance surrounded by the lighted portion of the sign.

9 Claims, 3 Drawing Sheets

CHANGEABLE LETTERS FOR SIGNS

This is a continuation application Ser. No. 08/075,817, filed Jun. 11, 1993, now abandoned.

BACKGROUND OF THE INVENTION

1. Field of the Invention

This invention concerns an illuminated light system including a changeable letter or other indicia for use with illuminated signs which presents different appearances when backlit and frontlit. More particularly, it concerns a changeable letter including a translucent plate bearing plural layers of superposed indicia-defining material, the materials being of contrasting colors.

2. Description of the Prior Art

Signage materials are presently offered which permit the user to select and display a desired message by interchanging different letters, symbols and numbers (collectively referred to herein as "letters"). These signs are well known, and typically include a source of illumination over which is placed a translucent panel. These panels, typically of colored plastic, enclose a box having a light source such as fluorescent or incandescent bulbs therein. The lights may be powered by an electrical source such as a battery, connected by an electric cord to an electrical outlet, or permanently wired to a fixed electrical power supply.

The letters are typically formed of an opaque material which is black or of another color. By placing the letters along tracks, a message can be presented on the sign. This is a convenient, durable and relative inexpensive way to present a message which can be readily altered as prices or other circumstances dictate.

However, in order to conserve energy, it may be desirable to turn the lights off during the daytime. When this is done, the letters are no longer lighted from the back (backlit) by the lights inside the box, but instead are illuminated by sunlight or other lighting from the front (frontlit). Depending on the color of the translucent panel, the solid color letters of the prior art may be more difficult to read in the daytime than at night. In addition, there may be circumstances where contrasting colors on the same letters, for example a light letter with a dark surrounding border, would enhance daytime visibility. There has thus arisen a need for a changeable letter system which is readily visible both when backlit and frontlit and is useful both in daytime and nighttime situations.

SUMMARY OF THE INVENTION

These objects have largely been met by the changeable letter system of the present invention. That is to say, the changeable letter hereof used in conjunction with an illuminated copy board presents excellent visibility when either backlit or frontlit. This is in large measure due to the fact that the letter hereof presents a blackened appearance when backlit, but alternatively the appearance of a letter having one or more colors surrounded by a border of another color when lighted from the front.

In greater detail, the present invention includes a letter comprising a plate of a translucent material, preferably made of glass or a durable synthetic resin material or the like. To this plate, a layer of a first indicia-defining material is applied. This first layer is opaque and thus presents a black-out appearance when lit from the back side of the plate. A second indicia-defining layer is positioned either on the first layer or on the plate, but in any event relatively forwardly of the first layer. The second layer is preferably of the same configuration as the first layer and of a somewhat smaller size, as well as being of a contrasting and preferably lighter color. Third and additional layers may be further superimposed on previous layers if multiple colors are to be used. Thus, when the letter is illuminated from the front, the letter presents a different appearance in that a border is provided around a smaller letter, symbol or numeral of a different and contrasting color. The letters may be readily combined on an illuminated copy board having a translucent, preferably contrastingly colored panel to present a message which is easy to read when either backlit or frontlit. The resulting changeable letter may present a more visually stimulating appearance which is more recognizable in the daytime than those changeable letters of the prior art.

DESCRIPTION OF THE PREFERRED EMBODIMENT

Figure 1:
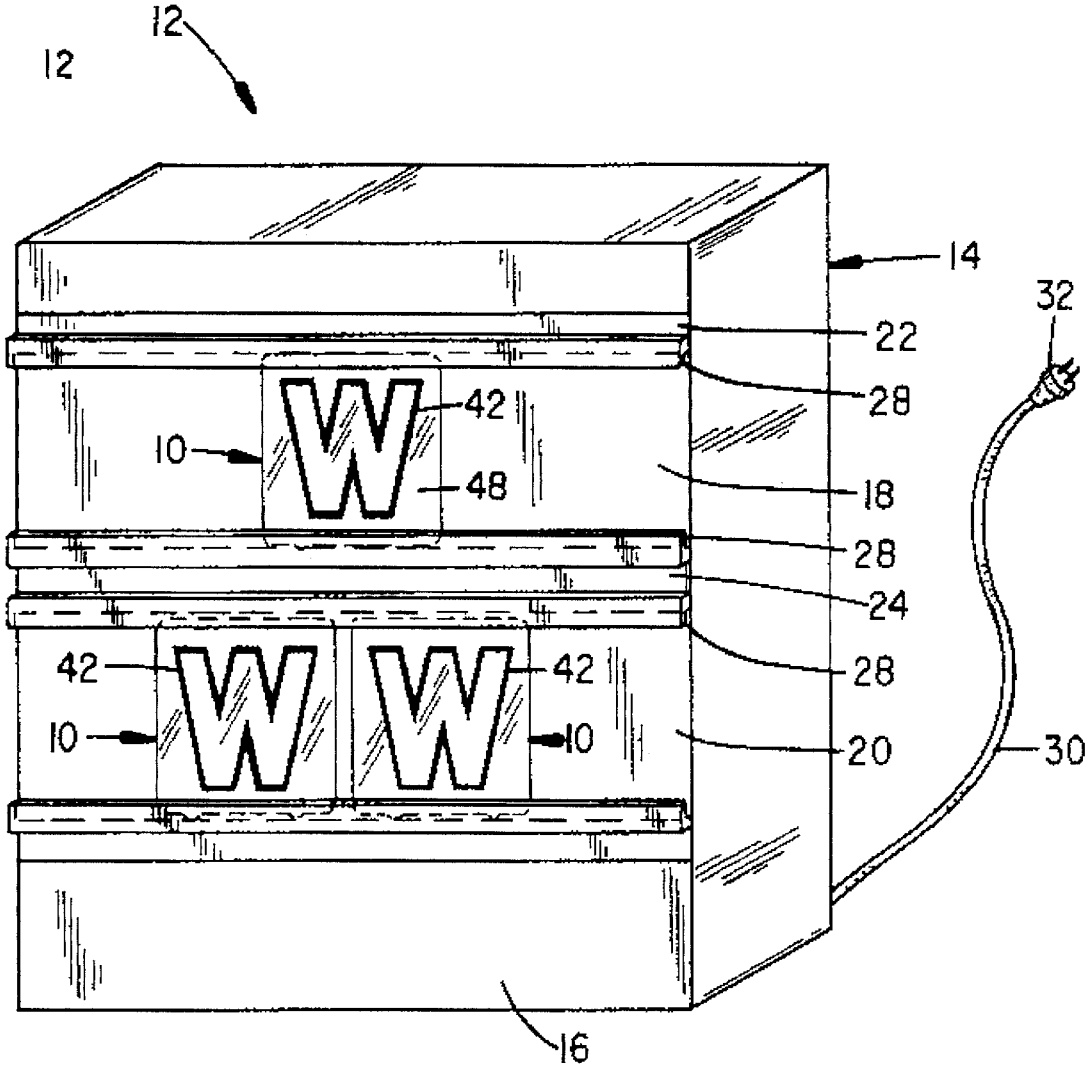
FIG. 1 is a front perspective view of a changeable letter system including an illuminated copy board for carrying the changeable letters hereof showing the changeable letters as they appear when illuminated from the front.

Referring now to the drawing, changeable letters 10 are carried by a copy board 12. The copy board 12 includes a box frame 14 which encloses a light source such as fluorescent lamps therewithin. The box frame includes a front surface 16 which may include one or more translucent panels 18 and 20. The panels 18 and 20 are preferably colored to contrast with the letters 10 and are interchangeably mounted by mounting brackets or screws to the box frame 14. Tracks 22, 24 and 26 each include lips 28 thereon for holding the changeable letters 10 in rows therealong. The tracks 22, 24 and 26 present individual changeable letters 10 to be placed along rails defined by the lips 28 to compose a message as desired by the user. The copy board 12 may be connected to a source of power such as a battery, permanently wired to fixed electrical power supply, or alternatively to a conventional electrical outlet by cord 30 and plug 32.

Figure 4:
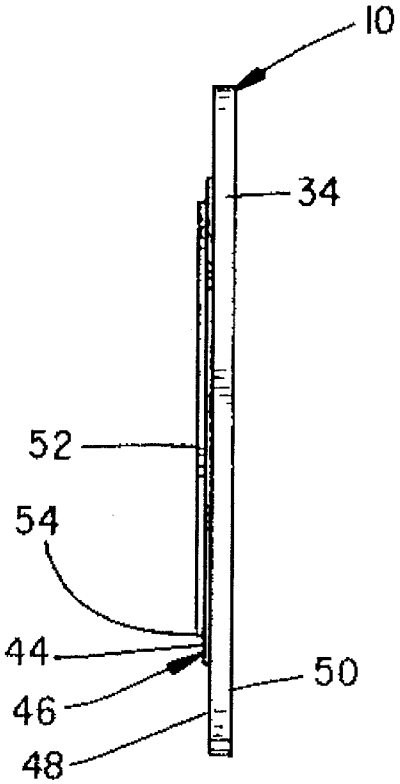
FIG. 4 is a side elevational view of the changeable letter hereof showing the layers of indicia-defining material.
Figure 3:
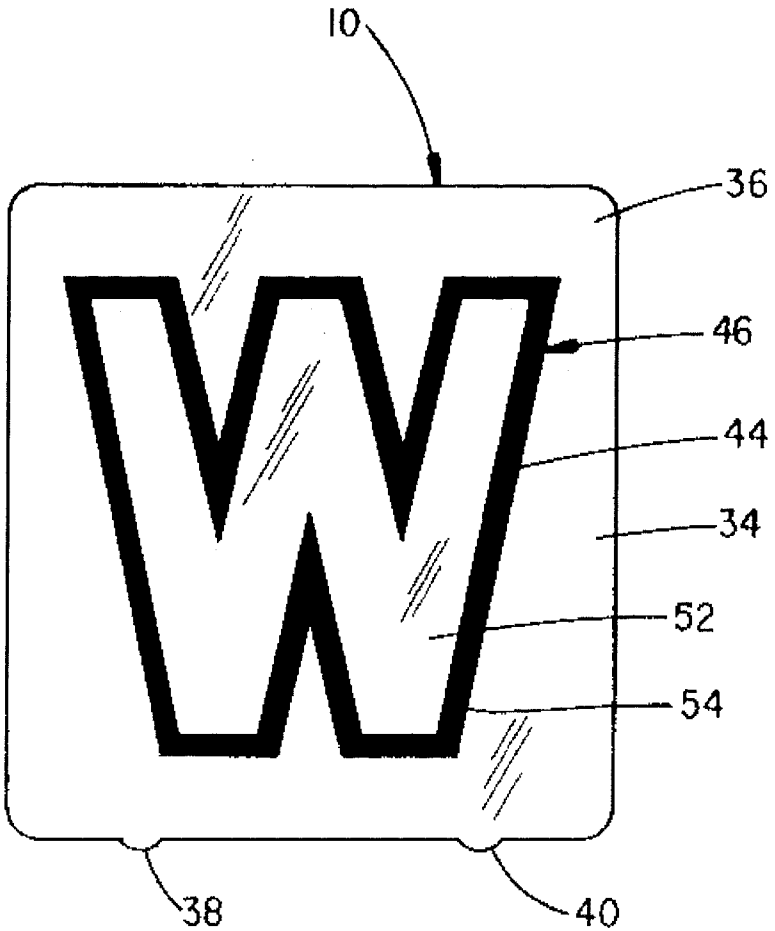
FIG. 3 is an enlarged front elevational view of a changeable letter hereof showing the appearance when illuminated from the front.

FIGS. 3 and 4 show a changeable letter 10 hereof in greater detail. Letter 10 includes a translucent plate 34 of synthetic resin material such as acrylic or the like. Alternatively, glass may be used for plate 34. Most preferably, the plate 34 is transparent and clear, so that the color (e.g., red) of the panel 18 or 20 positioned therebeneath is visible through the clear portion 36 of the letter 10. The plate 34 may include self-leveling feet 38 and 40 which are preferably located at the bottom of the plate 34.

Figure 2:
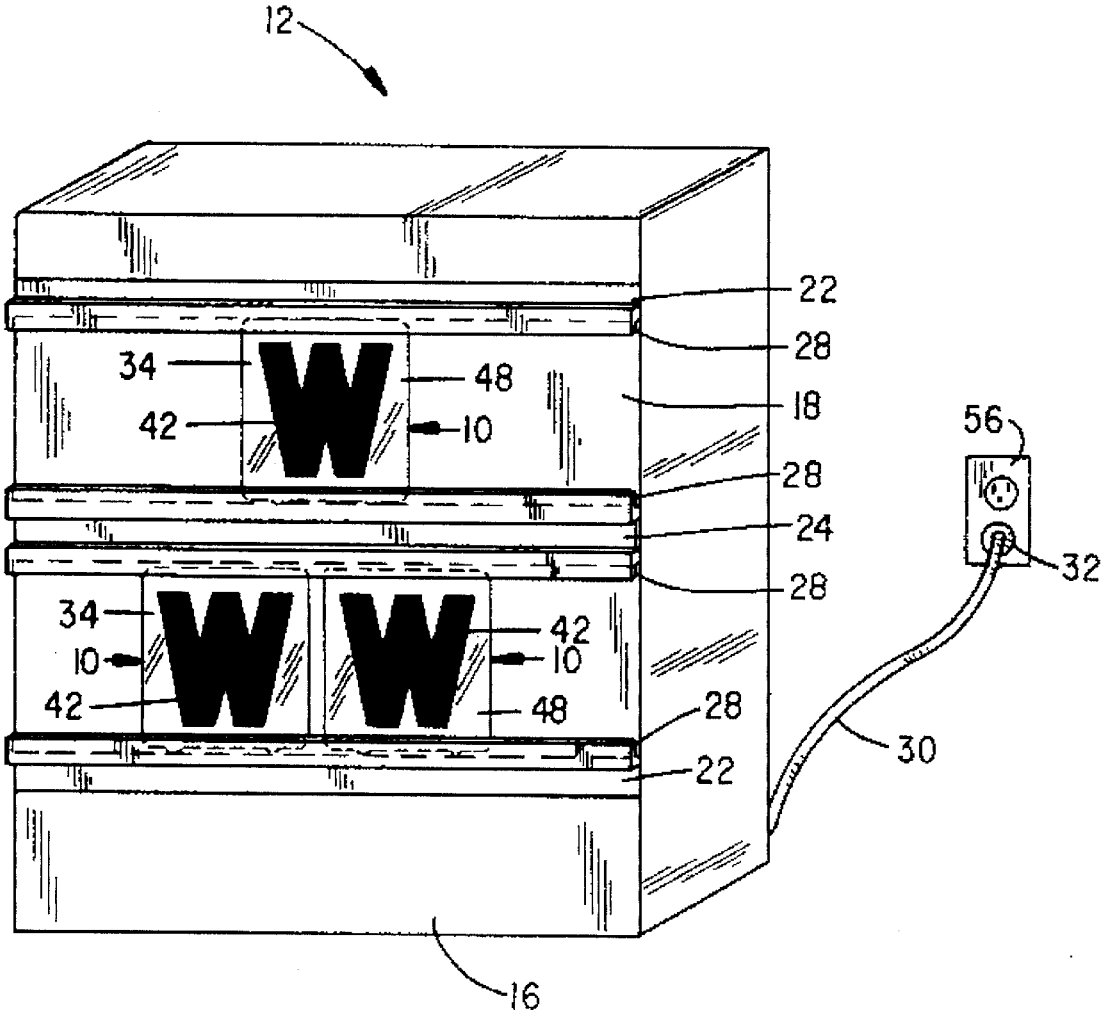
FIG. 2 is a front perspective view similar to FIG. 1 showing the system including the same changeable letters as they appear when illuminated from the back and not from the front.

The plate 34 carries thereon an indicia such as the letter "W" 42 shown in FIG. 2. The letter "W" is presented by applying a first layer 44 of opaque indicia-defining material such as paint, tape, or film to the plate 34 within outer margin 46 defining the letter "W" or other indicia. Plate 34 includes a front side 48 and a back side 50. First layer 44 may be applied to either front side 48 or back side 50, as desired.

A second layer 52 of indicia-defining material is applied to either the first layer 44 or directly to the plate 34 in superposed relationship to the first layer 44, but in any event is located relatively forwardly (toward the front side 48) thereof. The letter "W" or other desired indicia is formed, preferably continuously, by applying the second layer 52 within an outer edge 54. For example, FIG. 3 illustrates the placement of the second layer directly over the first layer 44, both being positioned on the front side of the plate 34. However, it is only necessary that the second layer 52 be applied in superposed relationship over the first layer 44 so that it is positioned relatively forwardly thereof. For example, in addition to the positioning of the layers 44 and 46 as shown in FIG. 4, the second layer 46 could be placed directly on the back side 50 and first layer 44 positioned thereover also on the back side 50, or alternatively the second layer 46 could be applied directly to the front side 48 and the first layer 44 applied directly to the back side 50. It may be appreciated that third and additional layers of material could be applied forwardly of and within the boundaries of the second layer 46 to present a further multi-colored-letter having the same properties as disclosed herein.

The material of the first layer 44 is preferably, substantially opaque and of a darker material than that of the second layer 52. Second layer 52 is preferably lighter in color, and in any event of a contrasting color, as compared to the first layer 44. That is to say, second layer 52 preferably reflects light more readily than first layer 44 whereby, when viewed from the front side in a frontlit condition, the letter "W" 42 presents the appearance of a lighter interior portion defined by the second layer 52 (or additional layers, as desired), surrounded by the relatively larger, darkened border presented by the first layer 44. It may be appreciated that different letters, symbols and numerals may be presented on the plate 34 and that the resulting changeable letters 10 may be lifted clear of or inserted into the tracks and positioned therealong in selected combinations to present a desired message.

However, when the illumination lamps within the box 14 are switched on, connected to a battery, connected to a permanent power supply, or plug 32 is electrically connected to a receptacle 56, changeable letter 10 is backlit rather than frontlit. This condition is illustrated by FIG. 2, wherein the visual impression is that of an entirely darkened letter "W" 42. This is because the opaque first layer 42 blocks the light passing through the panels 18 and 20 and, in the absence of front lighting causes the observer to see only the light passing through the panels 18 and 20 and the clear portion 36 of the plate 34. In this circumstance, the border effect is no longer observed and in fact the lighter colored second layer 52 tends to "disappear" into the darker background of the first layer 44. The color of the panels 18 and 20 are thus readily visible, presenting a contrasting background to the "blackout" appearance of the letters 42.

While the first and second layers 44 and 52 (or additional layers, as desired) may be of conventional paint, other materials can be used such as reflective or fluorescent paint, film or tape. The lighter colored material is preferably used as the second layer 52 and is thus smaller than the darker first layer 44.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. A changeable letter for signs comprising:

a) a translucent planar plate presenting a front side and a back side;

b) a first layer of a material having a substantially opaque color applied to a viewing surface at the front side and configured to define boundaries of a first indicia; and c) a second layer of a material configured to define boundaries of a second indicia and of a contrasting color to the first layer applied directly over said said first layer and wherein at least one boundary of said second indicia is smaller than an outer boundary of said first indicia, such that said first and second layers define an intelligible character bordered by a contrasting color and readable at the front side in daylight and backlit conditions.

2. A changeable letter as set forth in claim 1, wherein said first layer is applied substantially continuously within the outer boundaries of the indicia defined thereby.

3. A changeable letter as set forth in claim 1, wherein said first layer is of a relatively darker color than said second layer.

4. A changeable letter as set forth in claim 1, wherein said plate is transparent.

5. A changeable letter for signs comprising:

a) a transparent planar plate presenting a front side and a back side;

b) a first opaque colorant applied to a viewing surface at the front side and configured to define boundaries of a first indicia; and c) a second opaque colorant of a color contrasting to the first colorant applied directly over the first colorant and configured to define a second indicia identical to said first indicia and having at least one outer boundary of a relatively smaller size, such that said first and second layers define an opaque alphanumeric character bordered by a contrasting color which is readable at the front side in daylight and backlit conditions.

6. A system for displaying changeable letters comprising, in combination:

a) a copy board including a frame, means for supporting a changeable letter, a translucent panel, and means for illuminating said panel positioned rearwardly thereof; and b) a changeable letter supported by said supporting means, said letter comprising;

i) a translucent planar plate presenting a front side and a back side, wherein said back side abuts said panel, ii) a first opaque material applied to a viewing surface at the front side and configured to define boundaries of a first indicia, and iii) a second material of a substantially opaque contrasting color to the first material applied directly over the first material to define a second indicia having at least one outer boundary of a relatively smaller size than an outer boundary of the first indicia, such that said first and second materials define an opaque alphanumeric character bordered by a contrasting color which is readable at the front side in daylight and backlit conditions.

7. A system for displaying changeable letters as set forth in claim 6 wherein said plate is substantially clear and transparent.

8. A system for displaying changeable letters as set forth in claim 6 including a plurality of said letters, wherein each plate contains a single alphanumeric indicia, and wherein said letters are interchangeably carried by said copy board.

9. A system for displaying changeable letters as set forth in claim 7, wherein said letter support means comprises upper and lower track means for permitting said changeable letters to be moved and shifted therealong and wherein each track means includes a channel for receiving one of said plurality of letters.

* * * * *